US007216515B2

(12) United States Patent
Koo et al.

(10) Patent No.: US 7,216,515 B2
(45) Date of Patent: May 15, 2007

(54) METHOD FOR DISPLAYING PARTIAL STROKE OF WASHING MACHINE

(75) Inventors: Bon-Kwon Koo, Changwon-shi (KR); So-Young Cho, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 508 days.

(21) Appl. No.: 10/332,365

(22) PCT Filed: Jun. 29, 2001

(86) PCT No.: PCT/KR01/01125

§ 371 (c)(1),
(2), (4) Date: Jan. 7, 2003

(87) PCT Pub. No.: WO02/04735

PCT Pub. Date: Jan. 17, 2002

(65) Prior Publication Data

US 2003/0182976 A1 Oct. 2, 2003

(30) Foreign Application Priority Data

Jul. 7, 2000 (KR) ..... 2000-38928

(51) Int. Cl.
*D06F 33/00* (2006.01)

(52) U.S. Cl. ..... 68/12.23; 68/235 R

(58) Field of Classification Search ..... 68/12.23, 68/235 R, 213
See application file for complete search history.

(56) References Cited

U.S. PATENT DOCUMENTS 3,347,066 A * 10/1967 Klausner ..... 68/12.23
4,455,653 A * 6/1984 Le Gars et al. ..... 714/48
4,831,848 A * 5/1989 Arbizzani ..... 68/12.08
4,916,768 A * 4/1990 Broadbent ..... 8/159
5,386,362 A * 1/1995 Keret ..... 705/30
5,560,060 A * 10/1996 Dausch et al. ..... 8/158
5,897,671 A * 4/1999 Newman et al. ..... 8/158
6,850,252 B1 * 2/2005 Hoffberg ..... 715/716

FOREIGN PATENT DOCUMENTS

EP 0980929 A1 2/2000
GB 2 017 341 * 10/1979

(Continued)

*Primary Examiner*—Frankie L. Stinson
(74) *Attorney, Agent, or Firm*—McKenna Long & Aldridge LLP.

(57) ABSTRACT

A method for displaying a partial stroke mode of a washing machine is disclosed, which permits a user to recognize that a stroke mode other than a currently selected stroke mode is not performed if the user selects a partial stroke mode. The method for displaying a partial stroke mode of a washing machine having a display device includes the steps of displaying a whole washing stroke mode, which sequentially processes a series of stroke modes related with washing, and a partial washing stroke mode which processes some of the stroke modes if a power supply is applied, displaying courses corresponding to the partial washing stroke mode in the display device if the user selects the partial washing stroke mode, and displaying a guide message for a selected course in the display device if the user selects a desired course in the displayed courses. The method acts to prevent the user's undesired washing stroke mode from being performed and provides the user with convenience for use.

9 Claims, 10 Drawing Sheets

FOREIGN PATENT DOCUMENTS

| | | | |
|---|---|---|---|
| GB | 2 017 341 | A | 10/1979 |
| JP | 54-118796 | * | 9/1979 |
| JP | 60-135091 | * | 7/1985 |
| JP | 61-94682 | * | 5/1986 |
| JP | 62-144693 | | 6/1987 |
| JP | 63-214284 | * | 9/1988 |
| JP | 2-189185 | * | 7/1990 |
| JP | 7-163787 | * | 6/1995 |
| JP | 09-084989 | | 3/1997 |
| JP | 09-84989 | A | 3/1997 |
| JP | 9-201485 | * | 8/1997 |
| JP | 11-300076 | * | 11/1999 |
| JP | 2000-70585 | * | 3/2000 |
| KR | 1993-0002586 | A | 2/1993 |
| KR | 1996-0001285 | A | 1/1996 |
| KR | 1997-0062134 | A | 9/1997 |
| WO | WO 01/96644 | A1 | 12/2001 |

* cited by examiner

FIG. 5A regular course washing

15min

* no rinsing cycle or spinning cycle is conducted

FIG. 5B regular course press a spinning button

FIG. 5C regular course rinsing

3times

* no washing cycle or spinning cycle is conducted

FIG. 5D regular course spinning

5min

* no washing cycle or rinsing cycle is conducted

METHOD FOR DISPLAYING PARTIAL STROKE OF WASHING MACHINE

TECHNICAL FIELD

The present invention relates to a washing machine, and more particularly, to a method for displaying a particular cycle of a washing machine.

BACKGROUND ART

In general, the washing machine rotates a rotating tub, and a pulsator by a driving force of a motor, for conducting washing, rinsing, and spinning, wherein laundry is washed by using friction between the laundry, the washing water, and the rotating tub occurred as washing water and the laundry introduced in the rotating tub are pulsated.

A system and operation of a related art washing machine will be explained, with reference to the attached drawings. FIG. 1 illustrates a block diagram showing a system of a related art washing machine schematically, and FIG. 2 illustrates a flow chart showing operation of the related art washing machine.

Referring to FIG. 1, the related art washing machine is provided with a key application part 1 for selecting a user's desired function, a controlling part 2 for controlling cycles of the washing machine according to functions selected through the key application part 1, a load driving part 3 for driving different loads, such as a motor (not shown) a water supply valve (not shown), a drain valve (not shown), and the like in response to control signals form the controlling part 2, and a display part 4 for displaying operation states of the functions selected through the key application part 1 under the control of the controlling part 2. The display part 4 has 88 segments, and a plurality of light emission diodes LED for displaying a remained washing time period.

When the user applies an washing command by pressing keys on the key application part 1, the related art washing machine processes washing as the controlling part 2 applies control signals to the load driving part 3 according to a preset washing cycle sequence, to drive the motor (not shown), the water supply valve (not shown), the drain valve (not shown), and the like, in succession. Also, when the user applies the washing command, the controlling part 2 provides control signals so that particulars of the setting the user selects are displayed on the display part 4, when the display part 4 displays operation time periods, and remained washing time periods required for washing, rinsing, and spinning functions respectively for each of washing courses, in response to the control signals from the controlling part 2.

A related art method for controlling a particular cycle of the washing machine will be explained with reference to FIG. 2.

Referring to FIG. 2, power to the washing machine is turned on (S1). Then, user's selection of an all cycle mode is determined (S2). As a result of the determination (S2), if the user selects the all cycle mode, a desired washing course is selected (S3). Then, once pressing an operation button, washing cycles are conducted in an order of water supply→washing→rinsing→spinning (S4–S8). On the other hand, as a result of the determination (S2), if the user does not select the all cycle mode, implying that the user selects a particular cycle(s), selection of the washing cycle only is determined (S9). As a result of the determination (S9), if the user selects only the washing cycle, a desired washing time period is set by pressing washing buttons, and the operation button is pressed (S10–S11). Once the operation button is pressed, the washing cycle is conducted for the set washing time period (S12). Then, user's selection of the spinning cycle is determined (S13). As a result of the determination (S13), if the user selects the spinning cycle, the spinning cycle is conducted (S14). On the other hand, if the user selects the rinsing cycle only, a number of rinsing is set by a rinsing button, and the operation button is pressed (S15–S17). Once, the operation button is pressed, the rinsing cycle is conducted as many times as the user sets. If the rinsing cycle ends, and the user selects the spinning cycle, the spinning cycle is carried out as much as a preset time (S19–S20). If the user selects the spinning cycle only, a desired spinning time period is set by pressing a spinning button. Then, once the operation button is pressed, the spinning cycle is conducted for the set spinning time period (S23–S24). On the other hand, if the user selects both the washing cycle and the spinning cycle, a washing time period is set by the washing button, and a spinning time period is set by the spinning button (S25–S27). Then, once the operation button is pressed, the washing cycle is conducted for the set washing time period, and the spinning cycle is conducted for the set spinning time period, and the operation ends (S28–S30). If the user selects both the washing cycle and the rinsing cycle, a washing time period is set by the washing button, and a number of rinsing is selected by the rinsing button (S31–S33). Then, once the user presses the operation button, the washing cycle, and the rinsing cycle are conducted according to the set washing time period, and the set number of rinsing times. (S35–S39). If the user selects both the rinsing cycle and the spinning cycle, a number of rinsing is selected by the rinsing button, and a spinning time period is selected by the spinning button (S37–S39). Then, once the user presses the operation button, the rinsing cycle is conducted according to the number of rinsing set by the user, and the spinning cycle is conducted for the set spinning time period (S40–S42).

However, the foregoing related art washing machine has a problem in that the user can not know conducting of a particular cycle exactly, to be inconvenient in conducting the next cycle.

DISCLOSURE OF INVENTION

Accordingly, the present invention is directed to a method for displaying a particular cycle of a washing machine that substantially obviates one or more of the problems due to limitations and disadvantages of the related art.

An object of the present invention is to provide a method for displaying a particular cycle of a washing machine, which can make the user to know that cycles other than a currently selected cycle are not conducted.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for displaying a particular cycle of a washing machine having a display, includes the steps of (a) displaying an all cycle mode for conducting a series cycles related to washing in a sequence, and a particular cycle mode for conducting one or a combination of the cycles on the display when a power is applied to the washing machine, (b) displaying a course for the particular cycle mode on the display if a user selects the particular cycle mode, and (c) displaying a guide message for a selected course on the display when the user selects a desired course from the displayed courses, and conducting the selected course.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
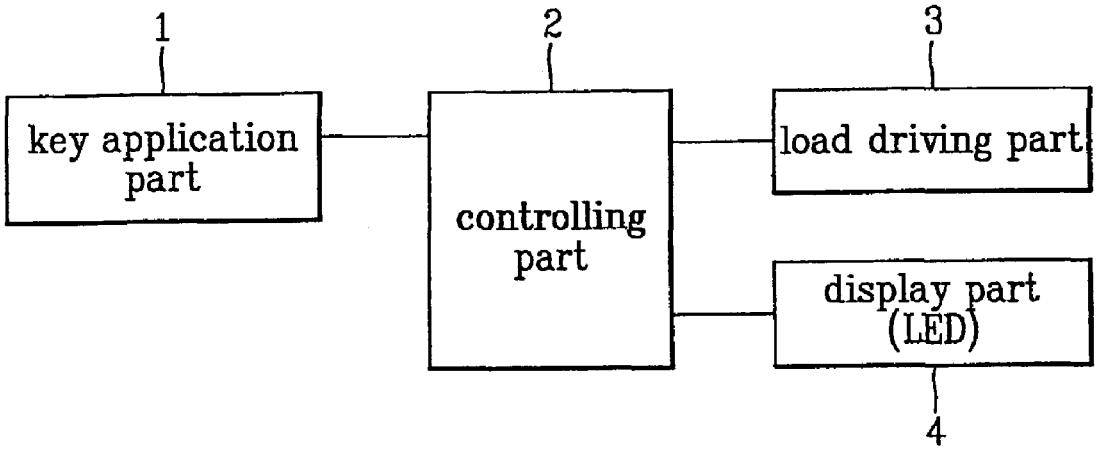
FIG. 1 illustrates a block diagram of a related art washing machine, schematically.
Figure 2A:
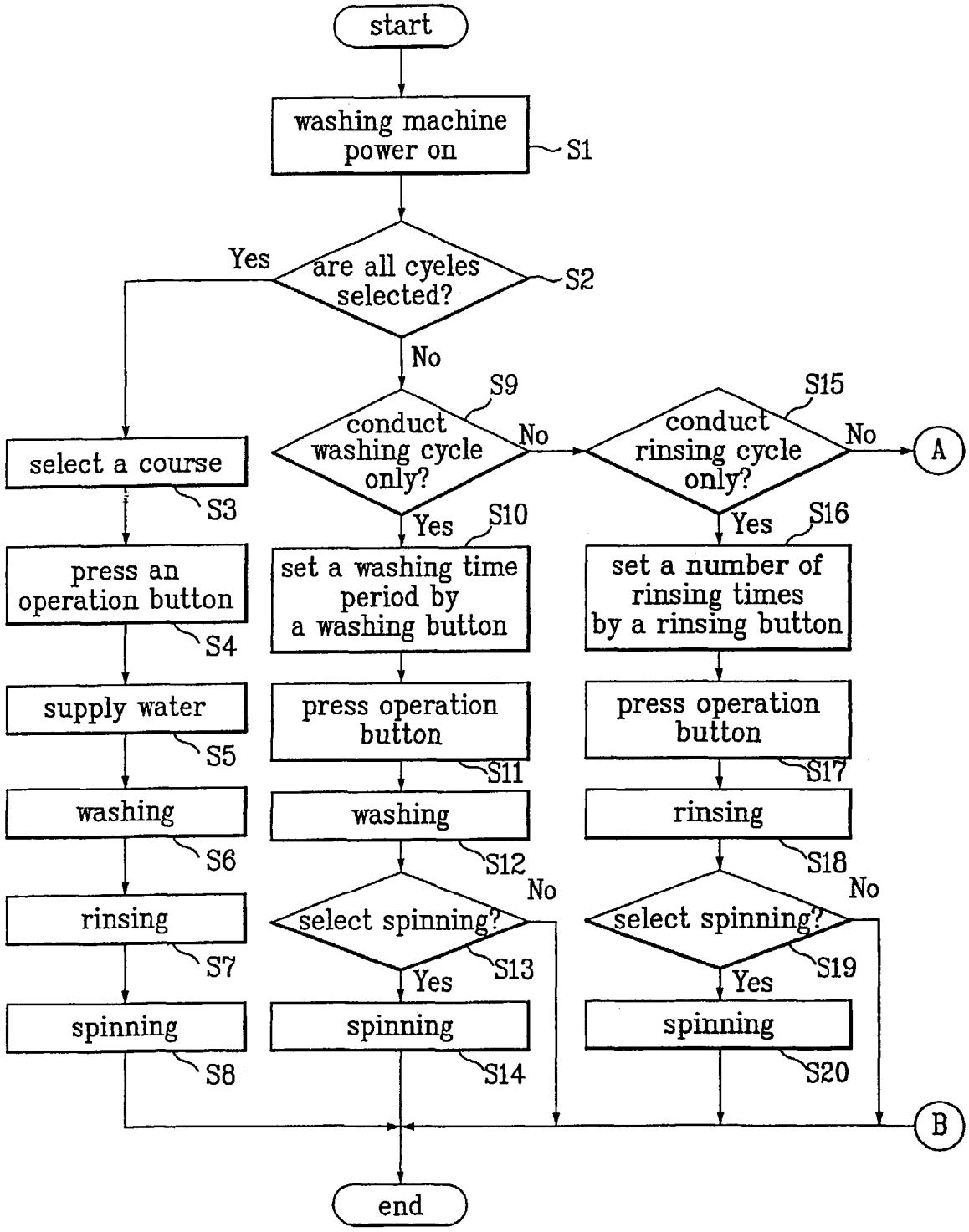
FIG. 2 illustrates a flow chart of an operation of a related art washing machine.
Figure 2B:
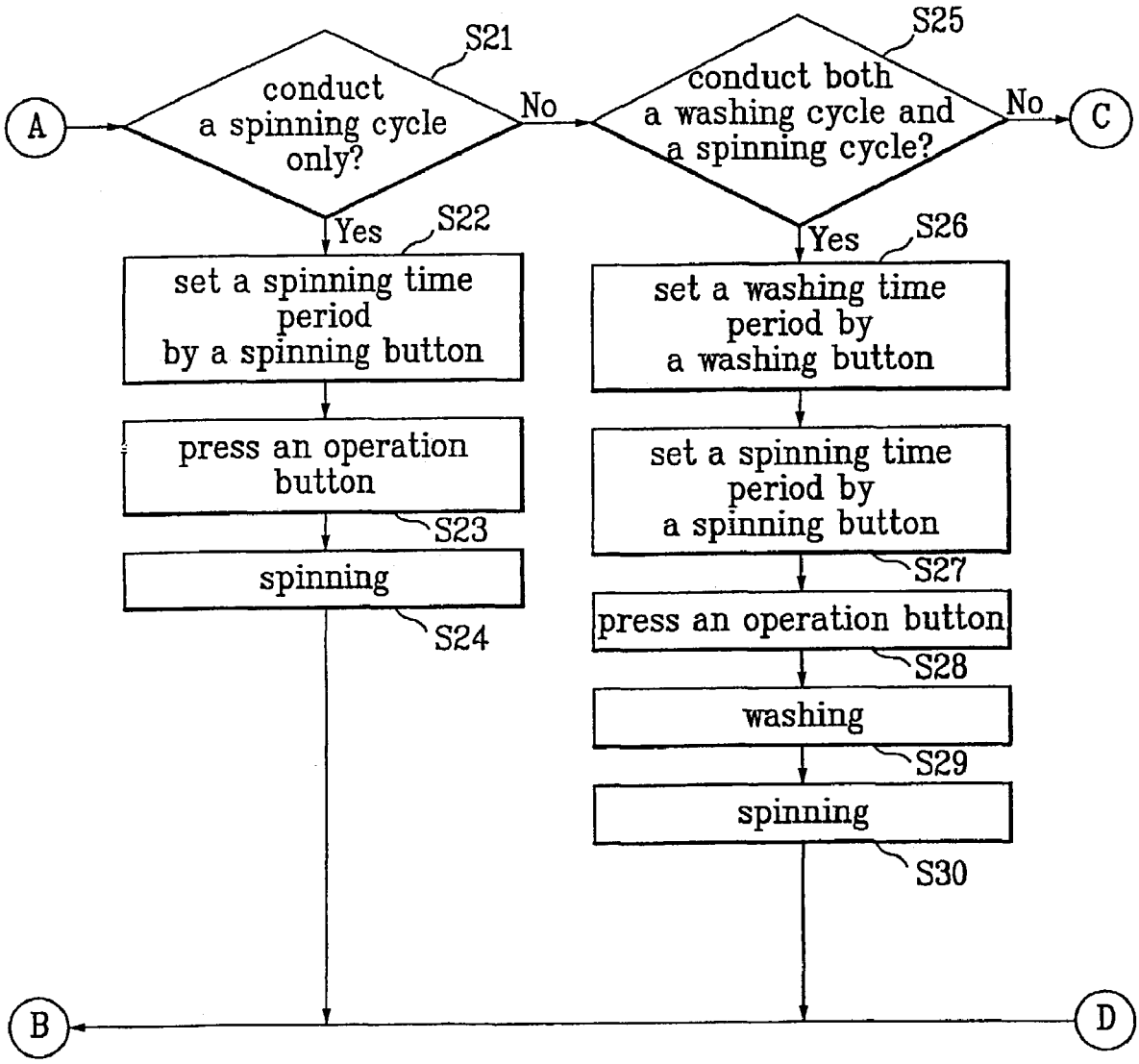
Figure 2C:
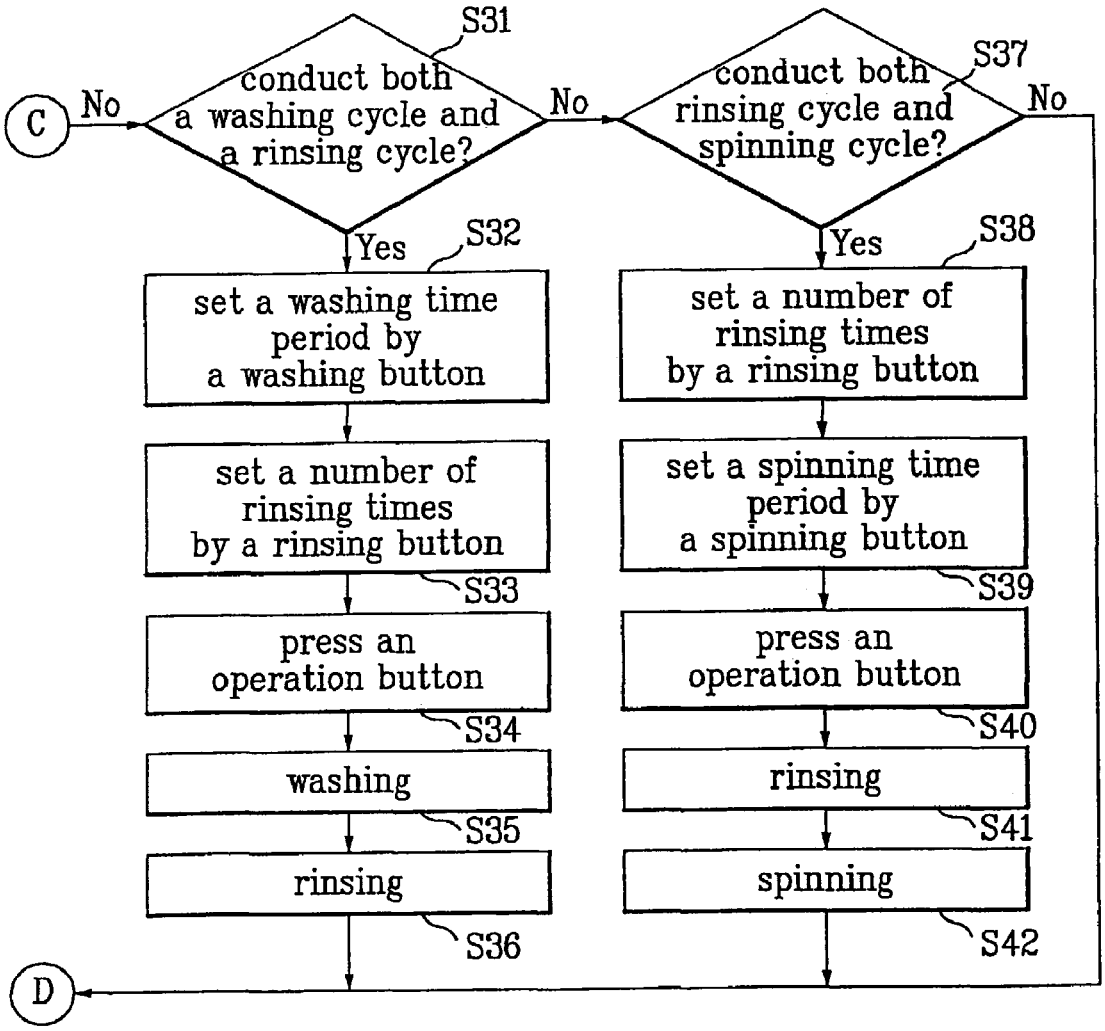
Figure 3:
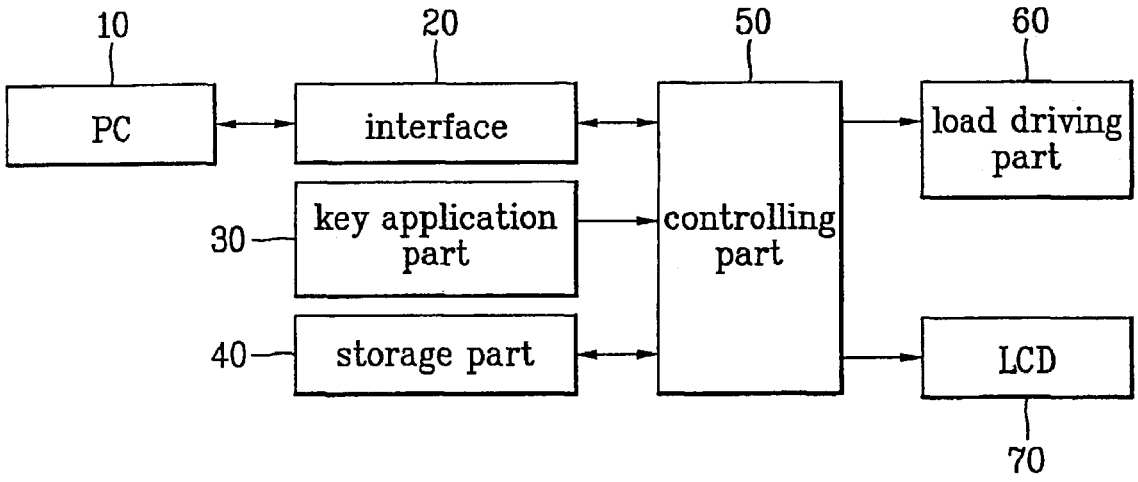
FIG. 3 illustrates a block diagram of a device for displaying a particular cycle of a washing machine in accordance with a preferred embodiment of the present invention.
Figure 4A:
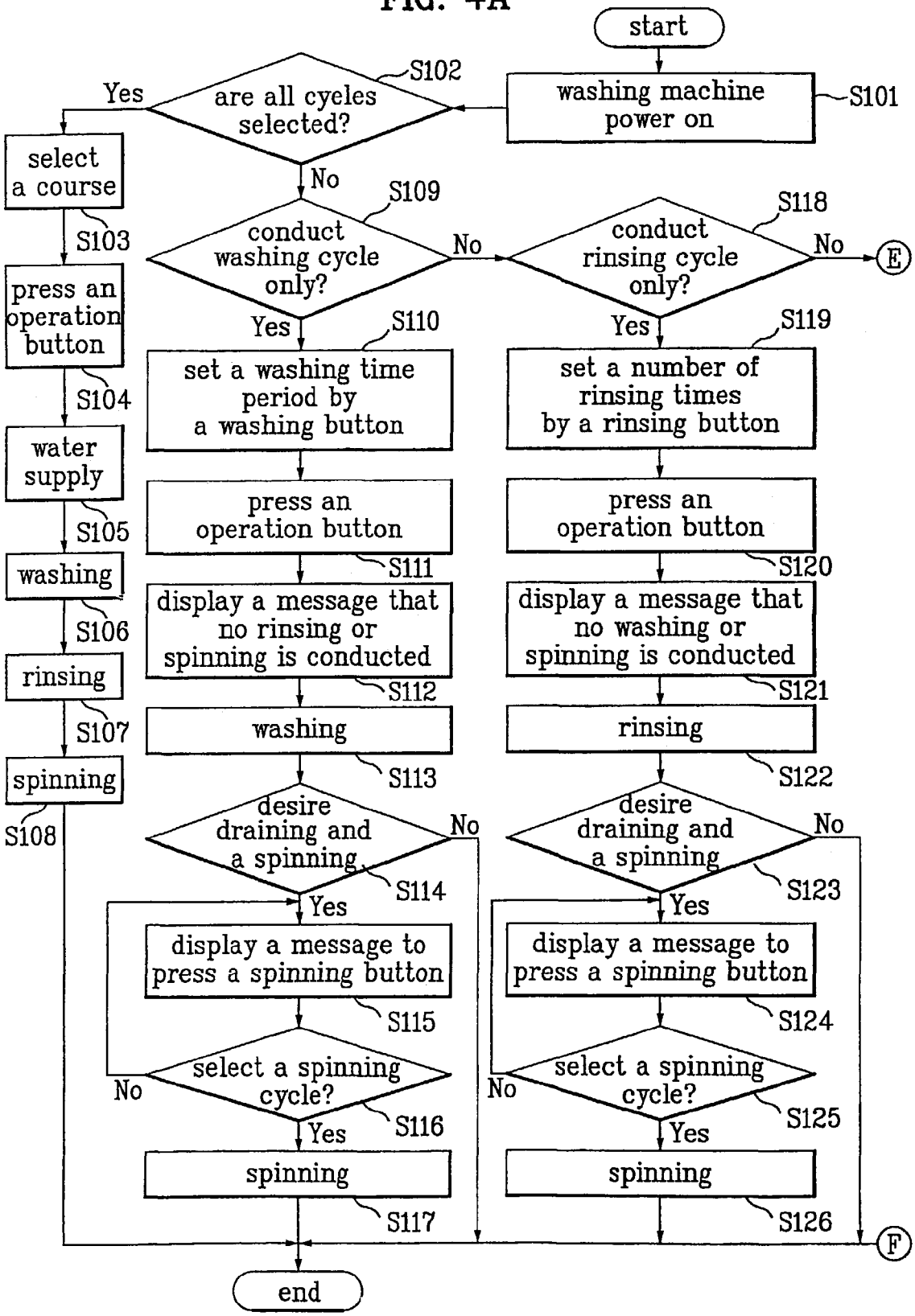
FIG. 4 illustrates a flow chart of a method for displaying a particular cycle of a washing machine in accordance with a preferred embodiment of the present invention; and, FIGS. 5A–5G illustrate LCDS showing the steps of a method for displaying a particular cycle of a washing machine in accordance with a preferred embodiment of the present invention.
Figure 4B:
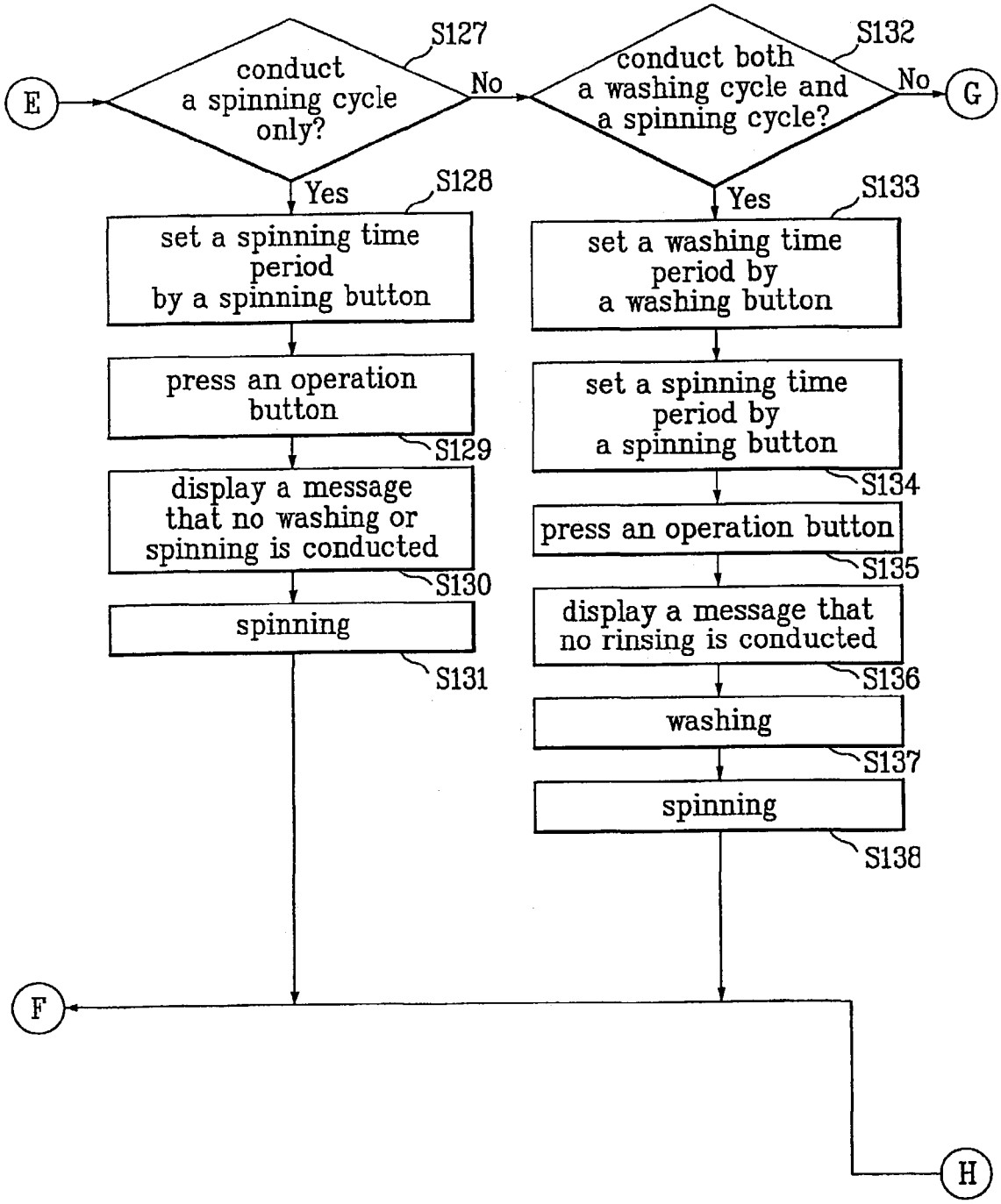
Figure 4C:
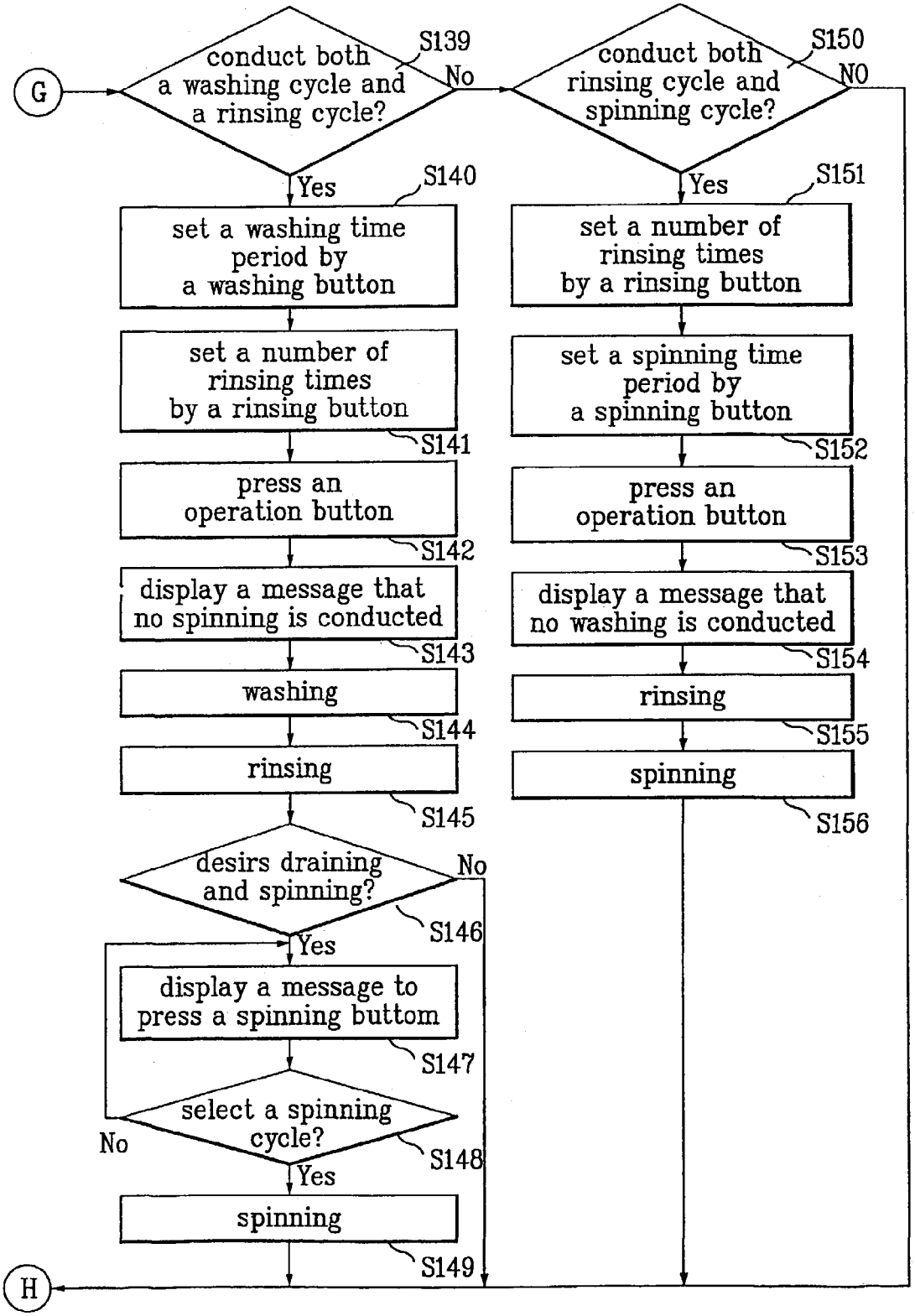

Reference will now be made in detail to the preferred embodiments of the present invention, examples of which are illustrated in the accompanying drawings. FIG. 3 illustrates a block diagram of a device for displaying a particular cycle of a washing machine in accordance with a preferred embodiment of the present invention, FIG. 4 illustrates a flow chart of a method for displaying a particular cycle of a washing machine in accordance with a preferred embodiment of the present invention, and FIGS. 5A–5G illustrate LCDS showing the steps of a method for displaying a particular cycle of a washing machine in accordance with a preferred embodiment of the present invention.

Referring to FIG. 3, the device for displaying a particular cycle of a washing machine in accordance with a preferred embodiment of the present invention includes an interface 20 for data exchange with outside of a washing machine, a key application part 30 for setting a washing course a user desires, a storage part 40 for storing a guide message for a washing course, an LCD (Liquid Crystal Display) 70 for displaying a guide message that no cycles will be conducted except a selected cycle, when a particular cycle is selected through the key application part 30, a controlling part 50 for controlling washing operation consistent with an operation command of a user given through the key application part 30, a guide message for a particular cycle to be displayed on the LCD 70 if the particular cycle is selected, and a data communication with an outside of the washing machine through the interface 20 by a user's request, and a load driving part 60 for controlling driving of loads in response to a control signal of the controlling part 50.

When the user presses a power key on the key application part 30, selects an all cycle mode, selects a desired washing course, and presses the operation button, the device for displaying a particular cycle of a washing machine has the LCD 80 to display a guide message on detection of a laundry amount stored in the storage part 40, and conducts detection of the laundry amount. That is, when the user presses the operation button, the controlling part 50 applies a control signal to the load driving part 60, to pulsate the motor (not shown) for a preset time period. Then, water is supplied to a level for the laundry amount, and washing is conducted for the selected course. After applying the power through the key application part 30, if the user selects a particular cycle mode, after displaying a guide message that no cycles are conducted except a selected cycle on the LCD 70, a cycle consistent with a set condition is conducted.

The foregoing method for displaying a particular cycle of a washing machine of the present invention will be explained, with reference to FIG. 4.

At first, power is applied to the washing machine (S101). Selection of the all cycle mode is determined (S102). Then, as a result of the determination (S102), if the user selects the all cycle mode, a desired course is selected (S103). Then, the operation button is pressed, and washing is conducted in an order of water supply→washing→rinsing→spinning (S105–S108). On the other hand (S102), if the user does not select the all cycle mode, selection of the washing cycle only is determined (S109). Then, as the result of the determination (S102), if the user selects the washing cycle only, a desired washing time period is set by the washing button, and the operation button is pressed (S110–S111). Upon pressing the operation button, the guide message that both the rinsing, and spinning cycles are not conducted is displayed on the LCD 70 (S112). When the guide message is displayed on the LCD 70, the washing cycle is conducted for the set washing time period (S113). After the washing cycle ends, if draining and conduction spinning cycle is desired, a guide message to press the spinning button is displayed on the LCD (S114–S115). If the spinning cycle is selected by the spinning button, the spinning cycle is conducted (S116–S117). If the user selects the rinsing cycle only, a number of desired rinsing times are set by the rinsing button, and the operation button is pressed (S118–S120). Upon pressing the operation button, a guide message that both the washing cycle and the spinning cycle are not conducted is displayed on the LCD 70 (S121). Then, the rinsing cycle is conducted according to the set rinsing times (S122). If the user desires to conduct draining and spinning cycle, a guide message to press the spinning button is displayed on the LCD 70 (S123–S124). If the user presses the spinning button to select the spinning cycle, the spinning cycle is conducted (S125–S126). If the user desires to conduct the spinning cycle only, after a desired spinning time period is set by the spinning button, the operation button is pressed (S127–S129). When the operation button is pressed, a guide message that no washing cycle and rinsing cycle are conducted is displayed on the LCD 70 (S130). Then, the spinning cycle is conducted for the set spinning time period (S131). If the user selects both the washing cycle and the spinning cycle, a washing time period is set by the washing button, a spinning time period is set by the spinning button, and the operation button is pressed (S132–S135). When the operation button is pressed, a guide message that no rinsing cycle is conducted is displayed on the LCD 70 (S136). Then, the washing and spinning cycles are conducted for the set washing time period, and spinning time period (S137–S138). When the user desires to conduct both the washing cycle and the rinsing cycle, a desired washing time period is set by the washing button, and a number of desired rinsing times are set by the rinsing button (S139–S141). When the user presses the operation button, a guide message that no spinning cycle is conducted is displayed on the LCD 70 (S143). Then, the washing and rinsing are conducted according to the set washing time period, and the number of desired rinsing times (S144–S145). When the rinsing cycle ends, it is determined if the draining and spinning are desired (S146). If the spinning is desired, a guide message to press the spinning button is displayed on the LCD 70 (S147). If the user presses the spinning button to select the spinning cycle, the spinning cycle is conducted for the set time period (S148–S149). Finally, if the user selects both the rinsing cycle and the spinning cycle, the rinsing button is pressed to set a number of rinsing times, and the spinning button is pressed to set a spinning time period (S150–S152). Then, when the user presses the operation button, a guide message that no washing is conducted is displayed on the LCD 70 (S153–S154). Then, the rinsing cycle and the spinning cycle are conducted for the set number of rinsing times and spinning time period (S155–S156).

Embodiments of display on the LCD 70 according to the particular cycle selected by the user will be explained, with reference to FIGS. 5A–5G.

Selecting the Washing Cycle Only

Referring to FIG. 5A, when a desired washing time period is set by pressing the washing button, and the operation button is pressed if the user desires to conduct the washing cycle only, the time period (for an example, 15 min.) set by the user, and a guide message "no rinsing, and spinning cycles will be conducted" are displayed on the LCD 70. Then, the washing machine conducts the washing cycle for the washing time period set by the user after the guide message is displayed on the LCD 70, and, in continuation, if the user selects the draining and the spinning cycle, as shown in FIG. 5B, a guide message "press the spinning button" is displayed on the LCD 70.

Selecting the Rinsing Cycle Only

Referring to FIG. 5C, when a desired number of rinsing times is set by pressing the rinsing button, and the operation button is pressed if the user desires to conduct the rinsing cycle only, the desired number of rinsing times (for an example, 3 times) set by the user, and a guide message "no washing, and spinning cycles will be conducted" are displayed on the LCD 70.

Selecting the Spinning Cycle Only

Referring to FIG. 5D, when a desired spinning time period is set by pressing the spinning button, and the operation button is pressed if the user desires to conduct the spinning cycle only, the spinning time period (for an example, 5 min.) set by the user, and a guide message "no washing, and rinsing cycles will be conducted" are displayed on the LCD 70.

Selecting Both the Washing Cycle and the Spinning Cycle

Figure 5E:
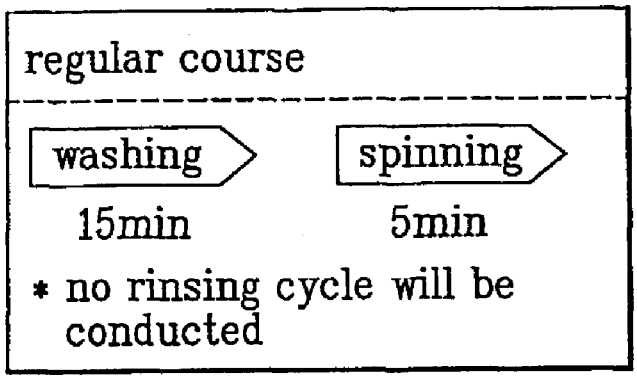

Referring to FIG. 5E, as the user desires to conduct both the washing, and spinning, if the operation button is pressed after a desired washing time period is set by pressing the washing button, and a desired spinning time period is set by pressing the spinning button, the washing time period (for an example, 15 min.) and the spinning time period (for an example, 5 min.) both set by the user, and a guide message "no rinsing cycle will be conducted" are displayed on the LCD 70.

Selecting Both the Washing Cycle and the Rinsing Cycle

Figure 5F:
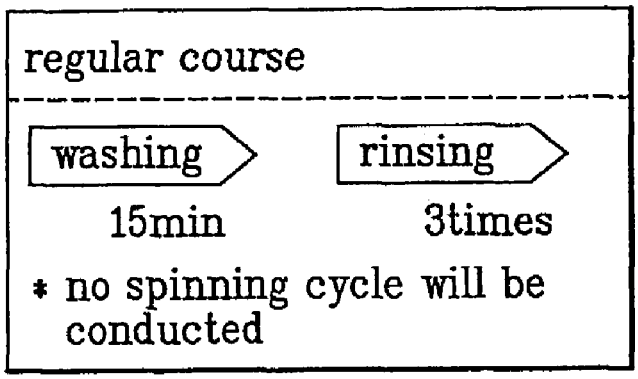

Referring to FIG. 5F, as the user desires to conduct both the washing and rinsing, if the operation button is pressed after a desired washing time period is set by pressing the washing button, and a desired number of rinsing times are set by pressing the rinsing button, the washing time period (for an example, 15 min.) and the number of rinsing times (for an example, 3 times) both set by the user, and a guide message "no spinning cycle will be conducted" are displayed on the LCD 70. When the washing cycle and the rinsing cycle come to an end, the washing machine is stationary without the water drained. In this instance, as shown in FIG. 5B, for the convenience of the user who may desire to drain the water or conduct the spinning cycle, it is displayed that the spinning button is available for the draining and the spinning.

Selecting Both the Washing Cycle and the Rinsing Cycle

Figure 5G:
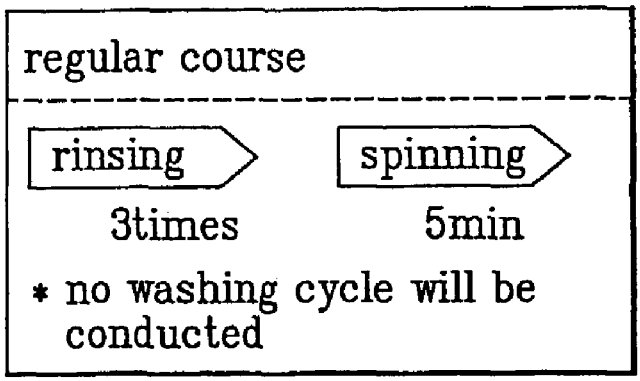

Referring to FIG. 5G, as the user desires to conduct both the rinsing and the spinning, if the operation button is pressed after a desired number of rinsing times are set by pressing the rinsing button, and a desired spinning time period is set by pressing the spinning button, the number of rinsing times (for an example, 3 times), and the spinning time period (for an example, 5 min.) both set by the user, and a guide message "no washing cycle will be conducted" are displayed on the LCD 70.

Thus, the device and method for displaying a particular cycle of a washing machine of the present invention displays a message that the cycles not selected by the user are conducted is displayed when the user desires to conduct, not all cycles, but a particular cycle, after the user turns on a power.

INDUSTRIAL APPLICABILITY

As has been explained, the device and method for displaying a particular cycle of a washing machine has the following advantages.

First, the conduction of a cycle not desired by the user is prevented in advance by displaying a guide message that no cycle except ones selected by the user is conducted in selection of a particular cycle.

Second, the convenience of the user can be enhanced by displaying methods for draining and spinning on an LCD when the washing tub has water filled therein.

Third, a reliability of the product can be enhanced because the washing cycles can be conducted as the user intends.

It will be apparent to those skilled in the art that various modifications and variations can be made in the device and method for displaying a particular cycle of a washing machine of the present invention without departing from the spirit or scope of the invention. Thus, it is intended that the present invention cover the modifications and variations of this invention provided they come within the scope of the appended claims and their equivalents.

What is claimed is:

1. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired washing time period when a user selects the particular cycle mode for conducting a washing cycle only;

displaying a guide message for a selected particular cycle on the display when the operation button is pressed, wherein the guide message displays a message indicating when rinsing or spinning cycle is not going to be conducted; and conducting the washing cycle according to the set washing time period.

2. A method as claimed in claim 1, wherein the step of conducting a washing cycle only further includes the steps of;

displaying a guide message to press a spinning button if the user selects a draining and the spinning cycle when the washing cycle comes to an end, and conducting the spinning cycle if the spinning cycle is selected with reference to the displayed guide message.

3. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired rinsing time period when a user selects the particular cycle mode for conducting a rinsing cycle only;

displaying a guide message for a selected particular cycle on the display when the operation button is pressed, wherein the guide message displays a message indicating which washing or spinning cycle is not going to be conducted; and conducting the rinsing cycle according to the set rinsing time period.

4. A method as claimed in claim 3, wherein the step of conducting a rinsing cycle only further includes the steps of;

displaying a guide message to press a spinning button if the user selects a draining and the spinning cycle when the spinning cycle comes to an end, and conducting the spinning cycle if the spinning cycle is selected with reference to the displayed guide message.

5. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired spinning time period when a user selects the particular cycle mode for conducting a spinning cycle only;

displaying a guide message for a selected particular cycle on the display when the operation button is pressed, wherein the guide message displays a message indicating which washing or rinsing cycle is not going to be conducted; and conducting the spinning cycle according to the set spinning time period.

6. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired washing time period and a desired spinning time period when a user selects the particular cycle mode for conducting both the washing cycle and the spinning cycle;

displaying a guide message for a selected particular cycle on the display when the operation button is pressed, wherein the guide message displays a message indicating which rinsing cycle is not going to be conducted; and conducting the washing cycle and the spinning cycle according to the set washing time period and the set spinning time period.

7. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired washing time period and a desired rinsing time period when a user selects the particular cycle mode for conducting both the washing cycle and the rinsing cycle;

displaying a guide message for a selected particular cycle on the display when the operation button is pressed, wherein the guide message displays a message indicating which spinning cycles is not going to be conducted; and conducting the washing cycle and the spinning cycle according to the set washing time period and the set spinning time period.

8. A method as claimed in claim 7, wherein the step of conducting both a washing cycle and a rinsing cycle further includes the steps of;

displaying a guide message to press a spinning button if the user selects a draining and the spinning cycle when the spinning, and rinsing cycle comes to an end, and conducting the spinning cycle if the user selects the spinning cycle with reference to the displayed guide message.

9. A method for displaying a particular cycle of a washing machine having a display, comprising the steps of;

displaying an all cycle mode for conducting in sequence a series of cycles related to washing, and a particular cycle mode for conducting one or a combination of the cycles on the display when power is applied to the washing machine;

user pressing an operation button after setting a desired rinsing time period and a desired spinning time period when a user selects the particular cycle mode for conducting both the rinsing cycle and the spinning cycle;

displaying a guide message for a selected particular cycle on the display when the operation button is pressed, wherein the guide message displays a message indicating which washing cycle is not going to be conducted; and conducting the rinsing cycle and the spinning cycle according to the set rinsing time period and the set spinning time period.

* * * * *